US010357967B1

(12) United States Patent
Nishimura

(10) Patent No.: US 10,357,967 B1
(45) Date of Patent: Jul. 23, 2019

(54) DRIVE CIRCUIT FOR A PRINTHEAD THAT CONVERTS A JETTING PULSE ON A DRIVE WAVEFORM TO A NON-JETTING PULSE

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/913,763

(22) Filed: Mar. 6, 2018

(51) Int. Cl.
*B41J 2/045* (2006.01)

(52) U.S. Cl.
CPC ..... *B41J 2/04596* (2013.01); *B41J 2/0455* (2013.01); *B41J 2/04528* (2013.01); *B41J 2/04541* (2013.01); *B41J 2/04581* (2013.01); *B41J 2/04588* (2013.01)

(58) Field of Classification Search
CPC ..... B41J 2/04596; B41J 2/04528
See application file for complete search history.

(56) References Cited

U.S. PATENT DOCUMENTS 6,331,052 B1 * 12/2001 Murai ..... B41J 2/04581 347/10
2012/0262512 A1 * 10/2012 Oshima ..... B41J 2/04541 347/10

* cited by examiner

*Primary Examiner* — Julian D Huffman
(74) *Attorney, Agent, or Firm* — Duft & Bornsen, PC

(57) ABSTRACT

Printheads for jetting a print fluid and associated methods. In one embodiment, the printhead includes a row of jetting channels configured to jet droplets of a print fluid, and a head driver that receives a data signal and a drive waveform comprising a series of jetting pulses. Responsive to the data signal indicating jetting by a jetting channel, the head driver applies one or more jetting pulses on the drive waveform to an actuator of the jetting channel to cause ejection of a droplet from a nozzle of the jetting channel. Responsive to the data signal indicating non-jetting by the jetting channel, the head driver clips the amplitude of a jetting pulse on the drive waveform to generate a non-jetting pulse that is applied to the actuator of the jetting channel. The non-jetting pulse creates movement of a fluid meniscus at the nozzle of the jetting channel without ejecting a droplet.

20 Claims, 11 Drawing Sheets

DRIVE CIRCUIT FOR A PRINTHEAD THAT CONVERTS A JETTING PULSE ON A DRIVE WAVEFORM TO A NON-JETTING PULSE

FIELD OF THE INVENTION

The following disclosure relates to the field of image formation, and in particular, to printheads and the use of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber. The deformation of the pressure chamber creates pressure waves within the pressure chamber that eject a droplet of print fluid (e.g., ink) out of the nozzle.

One problem with printheads is that a print fluid may settle and thicken in the pressure chamber at or near the nozzle where the print fluid is exposed to air. The viscosity of the print fluid may change due to exposure to air and sitting idle in a pressure chamber, which can negatively affect the jetting characteristics of the jetting channels. It is therefore desirable to design printheads that are less susceptible to these and other problems.

SUMMARY

Embodiments described herein provide enhanced drive circuits for printheads. A drive circuit as described herein selectively applies a drive waveform to actuators for jetting channels based on image data. For example, if the image data specifies jetting for a pixel at a jetting channel, then the drive circuit may apply one or more jetting pulses from the drive waveform to an actuator of the jetting channel. If the image data specifies non-jetting for a pixel at a jetting channel, then the drive circuit converts a jetting pulse from the drive waveform to a non-jetting or tickle pulse that is applied to an actuator of the jetting channel. The non-jetting pulse causes a fluid meniscus at the nozzle of the jetting channel to move without ejecting a droplet from the jetting channel. Thus, even though a droplet is not ejected from the jetting channel, the fluid meniscus is moved so that the print fluid doesn't settle or at least does not settle as fast. One advantage to converting a jetting pulse to a non-jetting pulse is that the drive waveform may contain a train of uniform jetting pulses, and does not have to be altered to include both non-jetting pulses and jetting pulses. This allows for the frequency of the jetting pulses on the drive waveform to be increased, which may increase printing speed of the printhead.

One embodiment comprises a printhead having one or more rows of jetting channels configured to jet droplets of a print fluid. Each jetting channel comprises an actuator, a pressure chamber, and a nozzle. The printhead also has a head driver configured to receive one or more data signals, and to receive a drive waveform comprising a series of jetting pulses. Each of the jetting pulses has an amplitude configured to eject a droplet from a jetting channel. Responsive to the data signal(s) indicating jetting by a jetting channel during a jetting period, the head driver is configured to apply one or more of the jetting pulses on the drive waveform to the actuator of the jetting channel. Responsive to the data signal(s) indicating non-jetting by the jetting channel during the jetting period, the head driver is configured to clip the amplitude of a jetting pulse on the drive waveform to generate a non-jetting pulse that is applied to the actuator of the jetting channel. The non-jetting pulse is configured to activate the actuator of the jetting channel to create movement of a fluid meniscus at the nozzle of the jetting channel without ejecting a droplet.

Another embodiment comprises a drive circuit for a printhead having one or more rows of jetting channels configured to jet droplets of a print fluid using actuators. The drive circuit includes a head driver comprising an electrical interface configured to receive one or more data signals representing data to be printed by the printhead. The head driver further comprises an electrical bus configured to receive a drive waveform comprising a series of jetting pulses. Each of the jetting pulses has an amplitude configured to eject a droplet from a jetting channel. The head driver further comprises a plurality of switching elements, where a switching element of the plurality of switching elements is connected between the electrical bus and an actuator of a jetting channel. The switching element is configured to close to enable a conductive path between the electrical bus and the actuator, and to open to disable the conductive path. Responsive to the data signal(s) indicating jetting by the jetting channel during a jetting period, the switching element is configured to apply at least one of the jetting pulses on the drive waveform to the actuator. Responsive to the data signal(s) indicating non-jetting by the jetting channel during the jetting period, the switching element is configured to clip the amplitude of a jetting pulse on the drive waveform to generate a non-jetting pulse that is applied to the actuator. The non-jetting pulse is configured to activate the actuator of the jetting channel to create movement of a fluid meniscus at a nozzle of the jetting channel without ejecting a droplet.

Another embodiment comprises a method for driving a printhead comprising one or more rows of jetting channels configured to jet droplets of a print fluid. The method comprises receiving one or more data signals, and receiving a drive waveform comprising a series of jetting pulses. The method further comprises selectively applying the drive waveform to actuators of the jetting channels based on the data signal(s). When the data signal(s) indicate jetting by a jetting channel during a jetting period, selectively applying the drive waveform comprises applying one or more of the jetting pulses on the drive waveform to an actuator of the jetting channel. When the data signal(s) indicate non-jetting by the jetting channel during the jetting period, selectively applying the drive waveform comprises clipping the amplitude of a jetting pulse on the drive waveform to generate a non-jetting pulse that is applied to the actuator of the jetting channel The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific illustrative embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
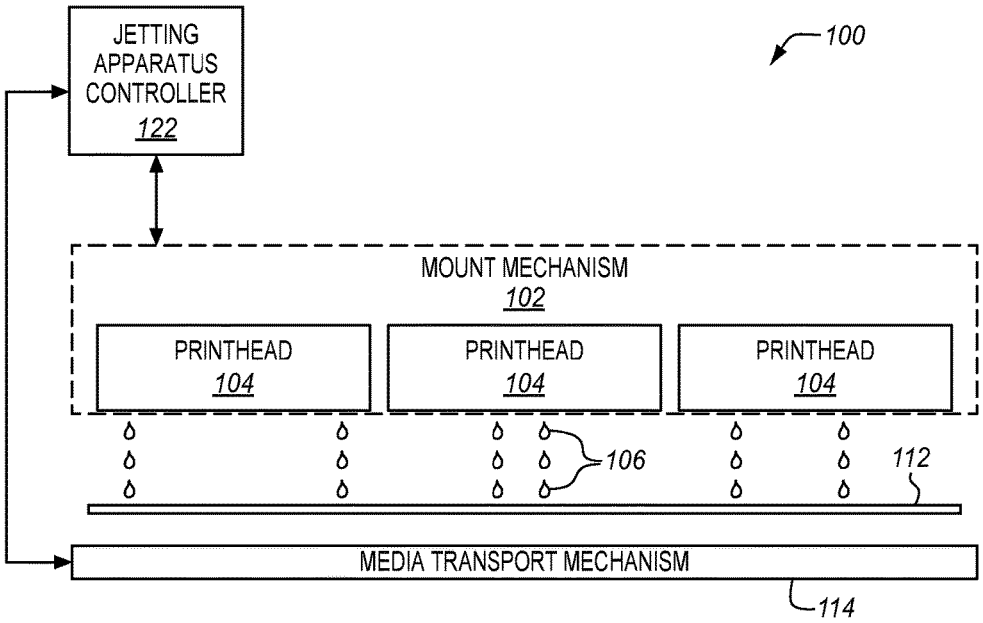
FIG. 1 is a schematic diagram of a jetting apparatus in an illustrative embodiment.

FIG. 1 is a schematic diagram of a jetting apparatus 100 in an illustrative embodiment. One example of jetting apparatus 100 is an inkjet printer that performs single-pass or multi-pass printing. Jetting apparatus 100 includes a mount mechanism 102 that supports one or more printheads 104 above a medium 112. Mount mechanism 102 may comprise a carriage assembly that reciprocates back and forth along a scan line or scan directions for multi-pass printing. Alternatively, mount mechanism 102 may be fixed within jetting apparatus 100 for single-pass printing. Printheads 104 are a device, apparatus, or component configured to eject droplets 106 of a print fluid, such as ink (e.g., water, solvent, oil, or UV-curable), through a plurality of orifices or nozzles (not visible in FIG. 1). The droplets 106 ejected from the nozzles of printheads 104 are directed toward medium 112. Medium 112 comprises any type of material upon which ink or another print fluid is applied by a printhead, such as paper, plastic, card stock, transparent sheets, a substrate for 3D printing, cloth, etc. Typically, nozzles of printheads 104 are arranged in one or more rows so that ejection of print fluid from the nozzles causes formation of characters, symbols, images, layers of an object, etc., on medium 112 as printhead 104 and/or medium 112 are moved relative to one another. Media transport mechanism 114 is configured to move medium 112 relative to printheads 104. Jetting apparatus 100 also includes a jetting apparatus controller 122 that controls the overall operation of jetting apparatus 100. Jetting apparatus controller 122 may connect to a data source to receive image data, and control each printhead 104 to discharge the print fluid on a desired pixel grid on medium 112.

Figure 2:
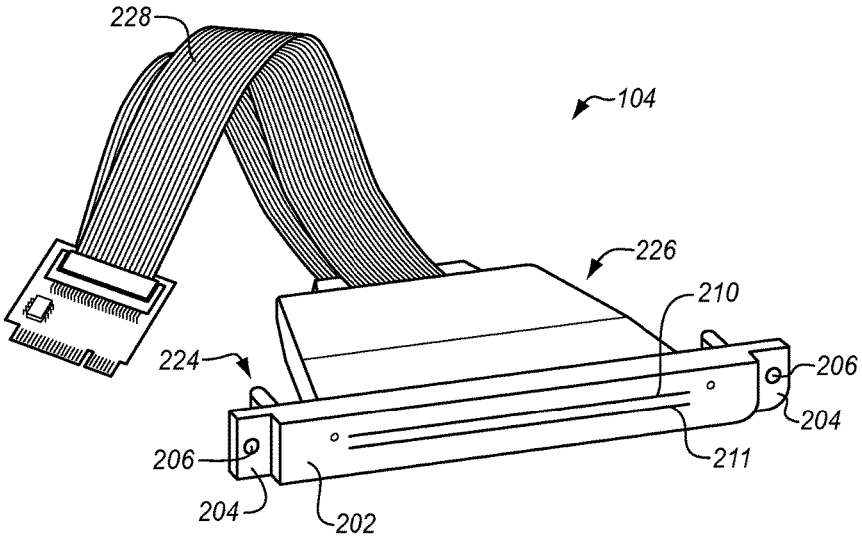
FIG. 2 is a perspective view of a printhead in an illustrative embodiment.

FIG. 2 is a perspective view of printhead 104 in an illustrative embodiment. Printhead 104 includes a nozzle plate 202, which represents the discharge surface of printhead 104. Nozzle plate 202 includes a plurality of nozzles that jet or eject droplets of print fluid, and the nozzles are arranged in rows 210-211. Although two rows 210-211 of nozzles are illustrated in FIG. 2, printhead 104 may include a single row of nozzles, three rows of nozzles, four rows of nozzles, etc. Printhead 104 also includes attachment members 204. Attachment members 204 are configured to secure printhead 104 to a jetting apparatus, such as to mount mechanism 102 as illustrated in FIG. 1. Attachment members 204 may include one or more holes 206 so that printhead 104 may be mounted within a jetting apparatus by screws, bolts, pins, etc. Opposite nozzle plate 202 is the side of printhead 104 used for input/output (I/O) of print fluid, electronic signals, etc. This side of printhead 100 is referred to as the I/O side 224. I/O side 224 includes electronics 226 that connect to a controller board through cabling 228, such as a ribbon cable. Electronics 226 control how the nozzles of printhead 104 jet droplets in response to control signals provided by the controller board.

Figure 3A:
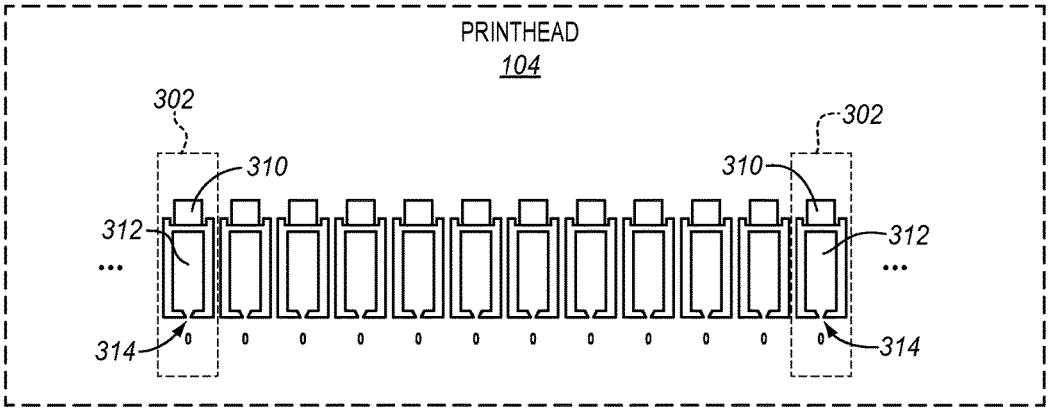
FIGS. 3A and 3B are schematic diagrams of a jetting channel within a printhead in an illustrative embodiment.
Figure 3B:
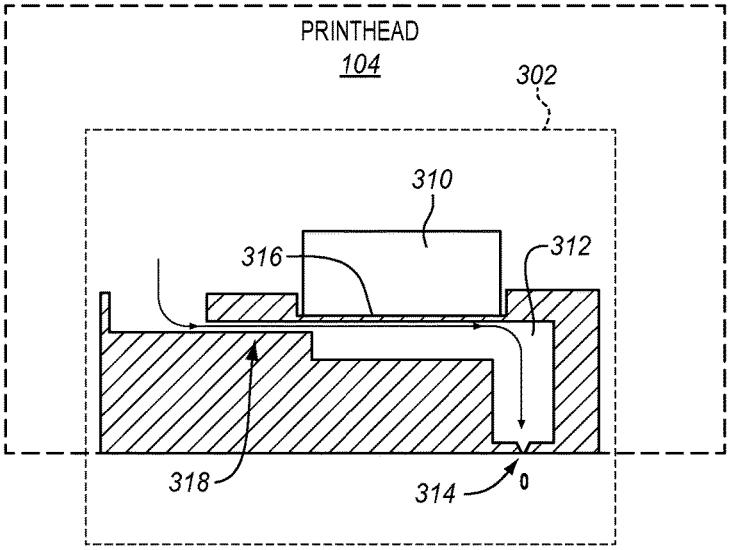

FIG. 3A is a schematic diagram of a row of jetting channels 302 within printhead 104 in an illustrative embodiment. Printhead 104 includes multiple jetting channels 302 that are arranged in a line or row (e.g., row 210 in FIG. 2) along a length of printhead 104, and each jetting channel 302 in a row may have a similar configuration as shown in FIG. 3A. Each jetting channel 302 includes a piezoelectric actuator 310, a pressure chamber 312, and a nozzle 314. FIG. 3B is a schematic diagram of a jetting channel 302 within printhead 104 in an illustrative embodiment. The view in FIG. 3B is of a cross-section of jetting channel 302 across a width of printhead 104. The arrow in FIG. 3B illustrates a flow path of a print fluid within jetting channel 302. The print fluid flows from a supply manifold in printhead 104 and into pressure chamber 312 through restrictor 318. Restrictor 318 fluidly connects pressure chamber 312 to a fluid supply, such as a supply manifold, and controls the flow of the print fluid into pressure chamber 312. One wall of pressure chamber 312 is formed with a diaphragm 316 that physically interfaces with piezoelectric actuator 310. Diaphragm 316 may comprise a sheet of semi-flexible material that vibrates in response to actuation by piezoelectric actuator 310. The print fluid flows through pressure chamber 312 and out of nozzle 314 in the form of a droplet in response to actuation by piezoelectric actuator 310. Piezoelectric actuator 310 is configured to receive a drive waveform, and to actuate or "fire" in response to a jetting pulse on the drive waveform. Firing of piezoelectric actuator 310 in jetting channel 302 creates pressure waves in pressure chamber 312 that cause jetting of a droplet from nozzle 314.

Jetting channel 302 as shown in FIGS. 3A-3B is an example to illustrate a basic structure of a jetting channel, such as the actuator, pressure chamber, and nozzle. Other types of jetting channels are also considered herein. For example, some jetting channels may be a "flow-through" type having another restrictor that fluidly connects pressure chamber 312 to a return manifold (not shown) in printhead 104. Some jetting channels may have a pressure chamber having a different shape than is illustrated in FIGS. 3A and 3B. Some jetting channels may use another type of actuator other than a piezoelectric actuator.

Figure 4:
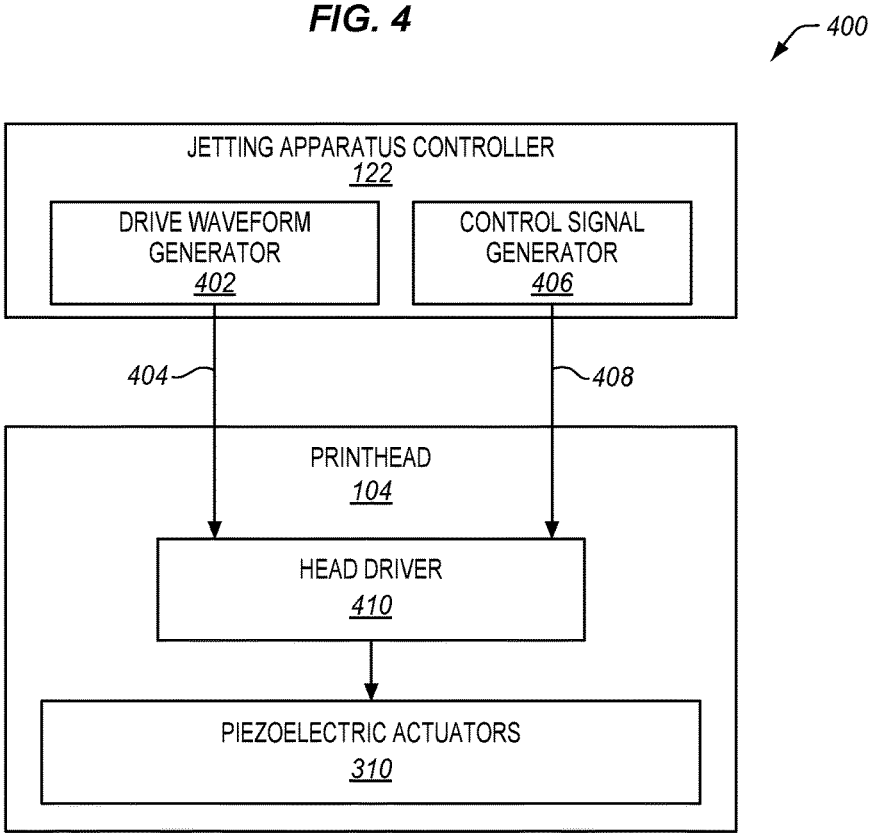
FIG. 4 is a block diagram illustrating a drive circuit for a printhead in an illustrative embodiment.

FIG. 4 is a block diagram illustrating a drive circuit 400 for printhead 104 in an illustrative embodiment. Drive circuit 400 is an apparatus or assembly of circuits/devices that controls printhead 104 to eject a print fluid on a medium to form pixels on the medium. Drive circuit 400 includes a drive waveform generator 402 configured to generate a drive waveform 404 (e.g., a trapezoidal waveform), and provide the drive waveform 404 to printhead 104 as a drive signal for piezoelectric actuators 310. Although not illustrated, drive waveform generator 402 may also include an amplifier circuit that amplifies the current of drive waveform 404. Drive circuit 400 also includes a control signal generator 406 configured to provide one or more control signals 408 to printhead 104 for selectively applying drive waveform 404 to individual jetting channels 302. Control signal generator 406 may receive image data, such as serial data, that specifies non-jetting or jetting by individual jetting channels 302 for pixels. One example of image data is a bitmap that defines pixel locations and values for each pixel location. In one embodiment, the image data may include two-bit values that define different grey-scale levels for individual pixels. In this example, a value of "00" may define non-jetting for a pixel by a jetting channel 302. A value of "01", "10", and "11" may define jetting of one, two, or three droplets, respectively, for a pixel by a jetting channel 302. Control signal generator 406 may process the image data, and generate control signals 408 that include data signals. The control signals may also include latch signals, a serial clock, gating signals, etc., which are described in further detail below.

Drive circuit 400 also includes a head driver 410 coupled to piezoelectric actuators 310. Head driver 410 may be an example of electronics 226 of printhead 104 as shown in FIG. 2. Head driver 410 is configured to selectively control which jetting channels 302 receive the drive waveform 404, and time windows when the jetting channels 302 receive the drive waveform 404. Head driver 410 may comprise an integrated circuit that is fabricated on printhead 104. Drive waveform generator 402 and control signal generator 406 are illustrated as part of jetting apparatus controller 122, which may couple to printhead 104 via a signal transmission cable, such as a flexible flat cable (FFC). In another embodiment, drive waveform generator 402 may also be part of an integrated circuit within printhead 104.

Piezoelectric actuators 310 are the actuating devices for jetting channels 302 that act to jet a droplet out of a nozzle 314 in response to a jetting pulse. A piezoelectric actuator 310, for example, converts electrical energy directly into linear motion. To jet from a jetting channel 302, one or more jetting pulses of the drive waveform 404 are provided to a piezoelectric actuator 310. A jetting pulse causes a deformation, physical displacement, or stroke of a piezoelectric actuator 310, which in turn acts to deform a wall of pressure chamber 312 (e.g., diaphragm 316). Deformation of the chamber wall generates pressure waves inside pressure chamber 312 that force a droplet from jetting channel 302 (when specific conditions are met). A standard jetting pulse is therefore able to cause a droplet to be jetted from a jetting channel 302 with the desired properties when the jetting channel 302 is at rest.

Figure 5:
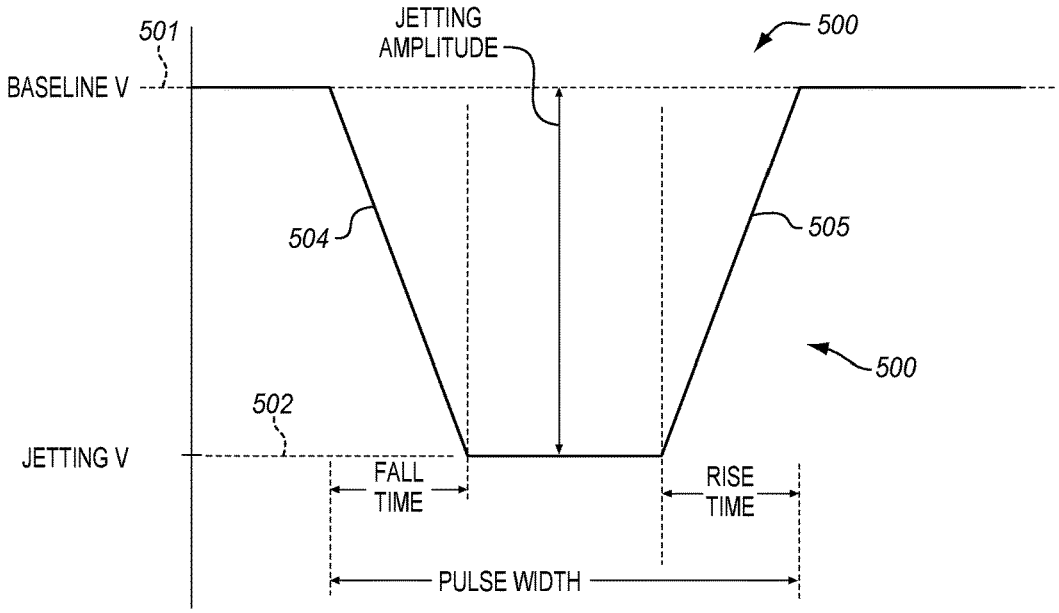
FIG. 5 illustrates a jetting pulse of a drive waveform for a printhead.

FIG. 5 illustrates a jetting pulse 500 of a drive waveform for a printhead. The drive waveform in FIG. 5 is shown as an active-low signal, but may be an active-high signal in other embodiments. Jetting pulse 500 has a trapezoidal shape, and may be characterized by the following parameters: fall time, rise time, pulse width, and jetting amplitude. Jetting pulse 500 transitions from a baseline (high) voltage 501 to a jetting (low) voltage 502 along a leading edge 504. The potential difference between the baseline voltage 501 and the jetting voltage 502 represents the amplitude of jetting pulse 500, which is a peak amplitude of jetting pulse 500. Jetting pulse 500 then transitions from jetting (low) voltage 502 to baseline (high) voltage 501 along a trailing edge 505. These parameters of jetting pulse 500 can impact the jetting characteristics of the droplets from the printhead (e.g., droplet velocity and mass). For example, when the amplitude of jetting pulse 500 equals a target jetting amplitude (i.e., the jetting voltage) for a target pulse width, a droplet of a desired velocity and mass is jetted from a jetting channel 302. A standard jetting pulse 500 may be selected for different types of printheads to produce droplets having a desired shape (e.g., spherical), size, velocity, etc.

The following provides an example of jetting a droplet from a jetting channel using jetting pulse 500, such as from jetting channel 302 in FIGS. 3A-3B. Jetting pulse 500 is initially at the baseline voltage 501, and transitions from the baseline voltage 501 to the jetting voltage 502. The leading edge 504 (i.e., the first slope) of jetting pulse 500 causes a piezoelectric actuator 310 to displace in a first direction, which enlarges pressure chamber 312 and generates negative pressure waves within pressure chamber 312. The negative pressure waves propagate within pressure chamber 312 and are reflected by structural changes in pressure chamber 312 as positive pressure waves. The trailing edge 505 (i.e., the second slope) of jetting pulse 500 causes the piezoelectric actuator 310 to displace in an opposite direction, which reduces pressure chamber 312 to its original size and generates another positive pressure wave. When the timing of the trailing edge 505 of jetting pulse 500 is appropriate, the positive pressure waves created by the piezoelectric actuator 310 displacing to reduce the size of pressure chamber 312 will combine with the reflected positive pressure waves to form a combined wave that is large enough to cause a droplet to be jetted from nozzle 314 of jetting channel 302. Therefore, the positive pressure waves generated by the trailing edge 505 of jetting pulse 500 acts to amplify the positive pressure waves that reflect within pressure chamber 312 due to the leading edge 504 of jetting pulse 500. The geometry of pressure chamber 312 and jetting pulse 500 are designed to generate a large positive pressure peak at nozzle 314, which drives the print fluid through nozzle 314.

Figure 6:
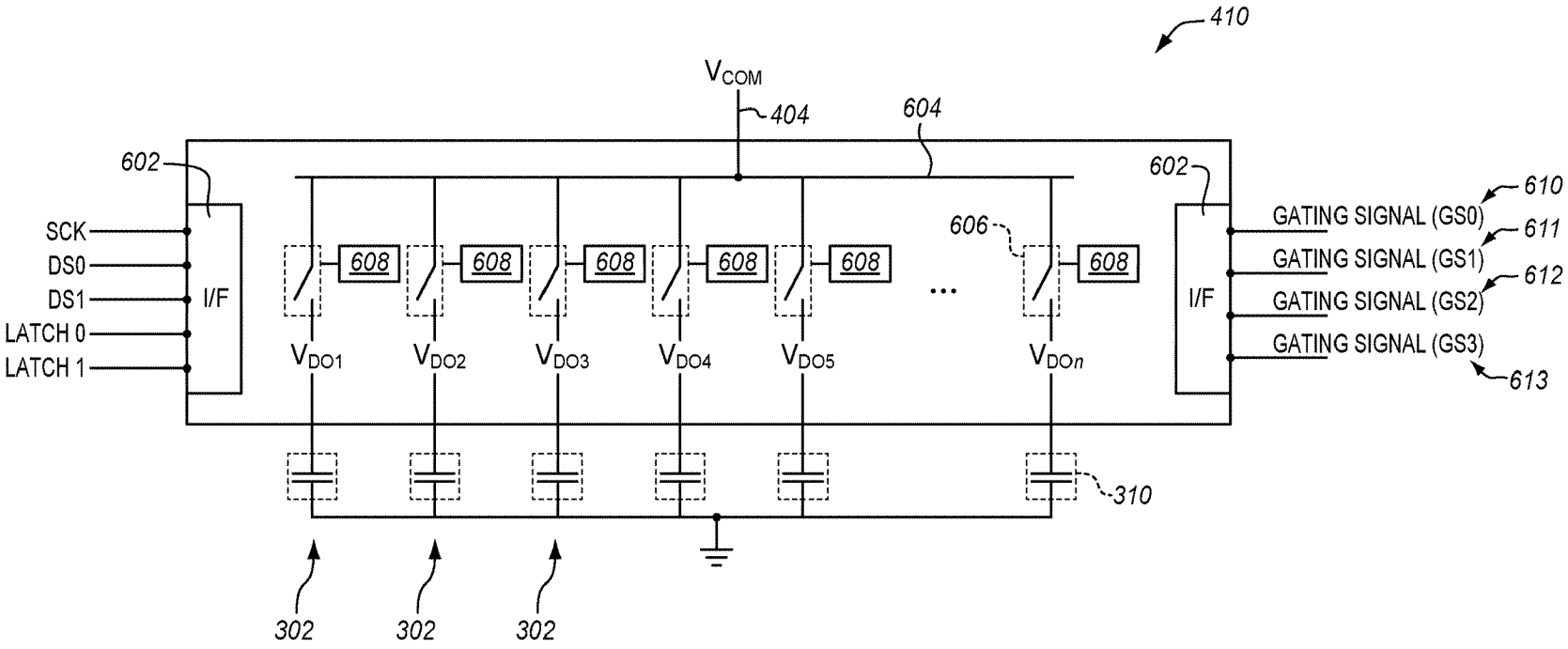
FIG. 6 is a schematic view of a head driver in an illustrative embodiment.

FIG. 6 is a schematic view of head driver 410 in an illustrative embodiment. Head driver 410 includes an electrical interface (I/F) 602 configured to receive one or more data signals (e.g., DS0 and DS1), and/or other control signals 408. Electrical interface 602 comprises any type of port, connectors, etc., configured to receive signals, such as over a ribbon cable. Head driver 410 also includes an electrical bus 604 configured to receive a drive waveform 404. Drive waveform 404 comprises a series of jetting pulses 500, and each of the jetting pulses has an amplitude configured to eject a droplet from a jetting channel, which is referred to as a jetting amplitude. Electrical bus 604 may comprise a conductive strip or bar (also referred to as a busbar) that conducts the drive waveform 404 and is available to provide the drive waveform 404 over a plurality of conductive paths.

Head driver 410 also includes a plurality of switching elements 606, which may also be referred to as transmission gates. A switching element 606 is associated with an individual jetting channel 302, which means that an individual switching element 606 is electrically coupled to a piezoelectric actuator 310 of a jetting channel 302 (which is illustrated as a capacitor). A switching element 606 is configured to selectively apply the drive waveform 404 to piezoelectric actuators 310 of jetting channels 302 based on a data signal(s). To selectively apply the drive waveform 404, a switching element 606 is configured to close to form or enable a conductive path between electrical bus 604 and a piezoelectric actuator 310, and to open to break or disable the conductive path. Switching element 606 may comprise a transistor, a logic switch, a gate or gate array, etc., that receives input and control signals, and outputs an output signal when the switch is closed.

Head driver 410 may also include a plurality of selectors 608 that are coupled to switching elements 606 or are integrated with switching elements 606. A selector 608 is a logic device or processing device that selects a gating signal for a switching element 606 of a jetting channel 302 based on one or more data signals. Electrical interface 602 is configured to receive a plurality of gating signals 610-613 from control signal generator 406 that control switching elements 606. A gating signal 610-613 is a digital signal that triggers passage of another signal (i.e., a drive waveform) or blocks the other signal. The timing of when a gating signal 610-613 is "on" or "off" defines time windows where drive waveform 404 is allowed to pass to a piezoelectric actuator 310. For instance, when a gating signal 610-613 is on, a switching element 606 will close and apply the drive waveform 404 (represented by Vcom) to a piezoelectric actuator 310 that is electrically coupled to that switching element 606 for the time period in which the switching element 606 is closed. When a gating signal 610-613 is off, a switching element 606 will open and the drive waveform 404 is blocked from a piezoelectric actuator 310 for the time period in which the switching element 606 is open.

In this embodiment, three of the gating signals 611-613 represent "active" gating signals for jetting by an active jetting channel during a jetting period. An active jetting channel is a jetting channel that is designated for jetting based on the data signal(s). When selector 608 selects one of the active gating signals 611-613 for a jetting channel 302, the active gating signal 611-613 will allow one or more jetting pulses on the drive waveform 404 to pass to a piezoelectric actuator 310 of the jetting channel 302 to cause a jetting of one or more droplets for a pixel.

Also in this embodiment, one of the gating signals 610 represents an "inactive" gating signal for an inactive jetting channel during a jetting period. An inactive jetting channel is a jetting channel that is not designated for jetting based on the data signal(s). When selector 608 selects the inactive gating signal 610 for a jetting channel 302, the inactive gating signal 610 will allow only a portion of a jetting pulse 500 to pass to a piezoelectric actuator 310 of a jetting channel 302 without causing a jetting of a droplet for a pixel. Inactive gating signal 610 is an enhanced gating signal in this embodiment as it allows a portion of a jetting pulse 500 on drive waveform 404 to pass to a piezoelectric actuator 310 of a jetting channel 302 without causing a jetting of a droplet for a pixel. The pattern or timing of the "on" and "off" states of inactive gating signal 610 converts a jetting pulse 500 on drive waveform 404 to a "non-jetting" or a "tickle" pulse that is applied to a piezoelectric actuator 310. For example, an inactive gating signal 610 is on for a first portion of a leading edge of a jetting pulse, and is off for a remaining portion of the leading edge of a jetting pulse. The inactive gating signal 610 is off for a first portion of a trailing edge of the jetting pulse, and is on for a remaining portion of the trailing edge of the jetting pulse.

A conventional gating signal may block a drive waveform from a piezoelectric actuator 310 to prevent jetting by a jetting channel for a pixel, or may allow a non-jetting pulse on a drive waveform (i.e., the drive waveform is altered to include both jetting pulses and non-jetting pulses) to pass to a piezoelectric actuator 310. In this embodiment, the pattern or timing of inactive gating signal 610 acts to clip the amplitude of a jetting pulse 500 on the drive waveform 404 to generate a non-jetting or tickle pulse that is applied to a piezoelectric actuator 310. A tickle pulse is defined as a pulse having a pulse width and amplitude configured to cause a fluid meniscus at a nozzle 314 of a jetting channel 302 to move without ejecting a droplet. Thus, when a tickle pulse is applied to a piezoelectric actuator 310, the jetting channel 302 will not jet in response to the tickle pulse.

Although four gating signals 610-613 are illustrated in this embodiment, more or less gating signals may be used in other embodiments as long as at least one of the gating signals comprises an inactive gating signal that acts to convert a jetting pulse on a drive waveform to a tickle pulse.

Figure 7:
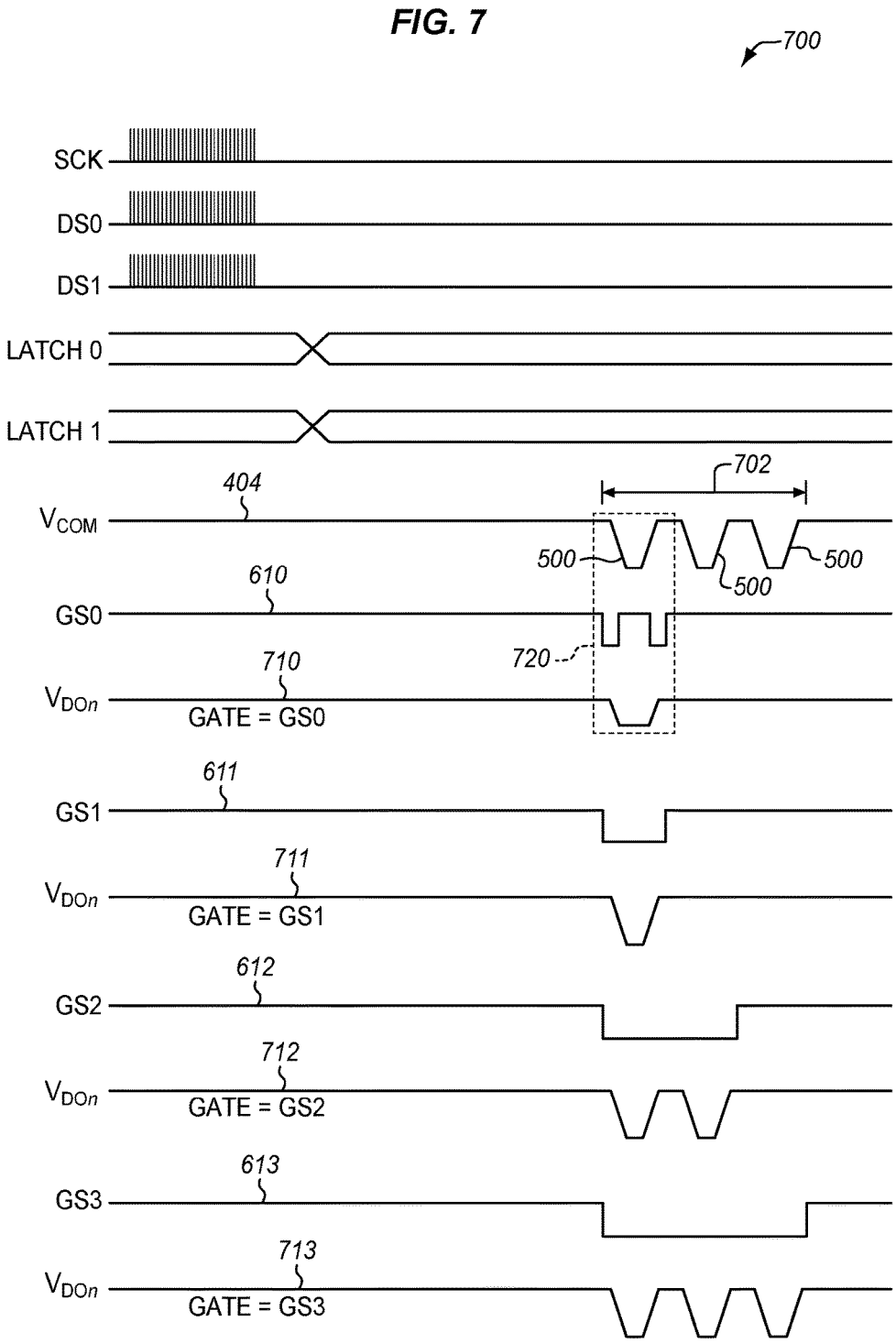
FIG. 7 is a signal diagram for a drive circuit in an illustrative embodiment.

FIG. 7 is a signal diagram 700 for drive circuit 400 in an illustrative embodiment. In this embodiment, signal diagram 700 shows a serial data clock (SCK), a data signals (DS0 and DS1), and latches (0 and 1). Signal diagram 700 also shows drive waveform 404 (i.e., Vcom). In this embodiment, drive waveform 404 includes a series or train of three jetting pulses 500 for a jetting period 702. A jetting period 702 comprises a time period designated for jetting by a jetting channel 302 for a pixel. For example, when a jetting channel 302 jets for an individual pixel, the jetting channel 302 will jet during the jetting period 702. Each of the jetting pulses 500 on drive waveform 404 is configured to cause a jetting at a jetting channel 302, which means that the pulse width and amplitude of each pulse is configured to activate a piezoelectric actuator 310 to cause jetting of a droplet from a jetting channel 302. Although three jetting pulses are used for jetting at a single pixel in this embodiment, more or less jetting pulses may be used within a jetting period 702 in other embodiments.

Signal diagram 700 also shows gating signals (GS) 610-613, and the corresponding output signals 710-713 ($V_{DO}$)

that is applied to a piezoelectric actuator 310 by a switching element 606. When a gating signal 610-613 is high or "off", a switching element 606 is open meaning that drive waveform 404 is blocked from a piezoelectric actuator 310. When a gating signal 610-613 is low or "on", a switching element 606 is closed meaning that drive waveform 404 is allowed to pass to a piezoelectric actuator 310.

Inactive gating signal 610 (GS0) has a pattern or timing configured to clip the amplitude of a jetting pulse 500 on the drive waveform 404 to generate a non-jetting pulse or tickle pulse on output signal 710, which is described in further detail below. Active gating signal 611 (GS1) is on (e.g., low) for a time window to allow one jetting pulse 500 on drive waveform 404 to pass on output signal 711 to a piezoelectric actuator 310. The single jetting pulse 500 will actuate a piezoelectric actuator 310 of a jetting channel 302 once, resulting in jetting of one droplet from the jetting channel 302. Active gating signal 612 (GS2) is on for a time window to allow two jetting pulses 500 to pass on output signal 712 to a piezoelectric actuator 310. The two jetting pulses 500 will actuate a piezoelectric actuator 310 of a jetting channel 302 twice, resulting in jetting of two droplets from the jetting channel 302. Active gating signal 613 (GS3) is on for a time window to allow three jetting pulses 500 to pass on output signal 713 to a piezoelectric actuator 310. The three jetting pulses 500 will actuate a piezoelectric actuator 310 of a jetting channel 302 three times, resulting in jetting of three droplets from the jetting channel 302. As is evident in FIG. 7, gating signals 610-613 control how head driver 410 selectively opens and closes a switching element 606 to control how the drive waveform 404 is applied to piezoelectric actuator 310.

Figure 8:
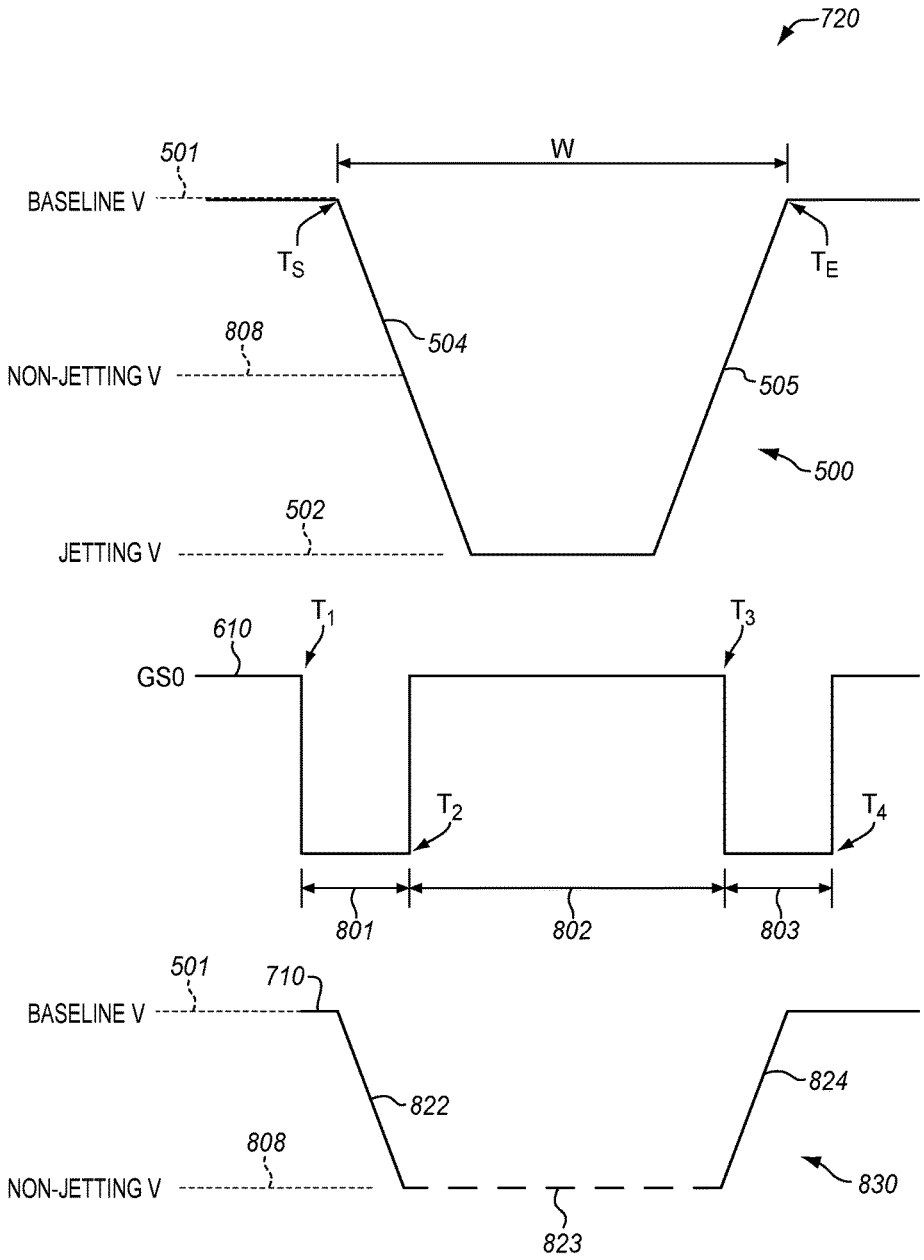
FIG. 8 illustrates a time interval in FIG. 7 in an illustrative embodiment.

FIG. 8 illustrates time interval 720 in FIG. 7 in an illustrative embodiment. Jetting pulse 500 has a pulse width (W) starting at time $T_S$ and ending at time $T_E$. The pattern or timing of inactive gating signal 610 is that it is on for a first time window 801 for a portion of the leading edge 504 of jetting pulse 500 between the baseline voltage 501 and a non-jetting voltage 808, and is off for a second time window 802 between the leading edge 504 and the trailing edge 505 of jetting pulse 500 when jetting pulse 500 exceeds the non-jetting voltage 808. Further, the pattern or timing of inactive gating signal 610 is on for a third time window 803 for a portion of the trailing edge 505 of jetting pulse 500 between the non-jetting voltage 808 and the baseline voltage 501, and is off after jetting pulse 500 reaches the baseline voltage 501 again. The non-jetting voltage 808 is a voltage between the baseline voltage 501 and the jetting voltage 502 that causes deformation of a piezoelectric actuator 310 but does not cause jetting from a jetting channel 302. The non-jetting voltage 808 may be in the range of 40% to 60% of the jetting voltage 502.

The pattern or timing of inactive gating signal 610 acts to clip the amplitude of jetting pulse 500 to generate a non-jetting pulse 830. To clip the amplitude of a jetting pulse means to limit a pulse being applied to a piezoelectric actuator 310 to a predetermined voltage level, which is a non-jetting voltage 808. At or before time $T_S$, inactive gating signal 610 transitions from off to on at time $T_1$. With inactive gating signal 610 on, a switching element 606 will allow a portion of the jetting pulse 500 (i.e., a portion of the leading edge 504) to pass to a piezoelectric actuator 310 on output signal 710 during time window 801. The portion of the jetting pulse 500 that is allowed to pass during time window 801 generates a leading edge 822 of non-jetting pulse 830. Inactive gating signal 610 transitions from on to off at time $T_2$ when the leading edge 504 of jetting pulse 500 reaches the non-jetting voltage 808 but before reaching the jetting voltage 502. With inactive gating signal 610 off, switching element 606 will block a portion of the jetting pulse 500 from piezoelectric actuator 310 on output signal 710 during time window 802. Because jetting pulse 500 is blocked during time window 802, no signal will be output on output signal 710 from switching element 606. Thus, this portion of non-jetting pulse 830 is illustrated as a dotted line, and represents a peak amplitude 823. Inactive gating signal 610 transitions from off to on at time $T_3$ when the trailing edge 505 of jetting pulse 500 reaches the non-jetting voltage 808 but before reaching the baseline voltage 501. With inactive gating signal 610 on, switching element 606 will allow a portion of the jetting pulse 500 (i.e., a portion of the trailing edge 505) to pass to a piezoelectric actuator 310 on output signal 710 during time window 803. The portion of the jetting pulse 500 that is allowed to pass during time window 803 generates a trailing edge 824 of non-jetting pulse 830. Inactive gating signal 610 then transitions from on to off at time $T_4$ after or when the trailing edge 505 of jetting pulse 500 reaches the baseline voltage 501.

The pattern or timing of inactive gating signal 610 therefore converts jetting pulse 500 into a non-jetting pulse 830. Non-jetting pulse 830 may be a trapezoidal pulse like jetting pulse 500, but the amplitude of non-jetting pulse 830 is limited to a threshold amplitude that will not cause jetting at a jetting channel 302. The timing of $T_2$ and $T_3$ may be selected so that the maximum voltage of non-jetting pulse 830 is equal to or less than the non-jetting voltage 808. Peak amplitude 823 of non-jetting pulse 830 is shown as a flat line between leading edge 822 and trailing edge 824. A piezoelectric actuator 310 may store potential energy, like a capacitor, so a voltage is retained in a piezoelectric actuator 310 after firing. This stored voltage of a piezoelectric actuator 310 is illustrated as the flat line between leading edge 822 and trailing edge 824 of non-jetting pulse 830.

Figure 9:
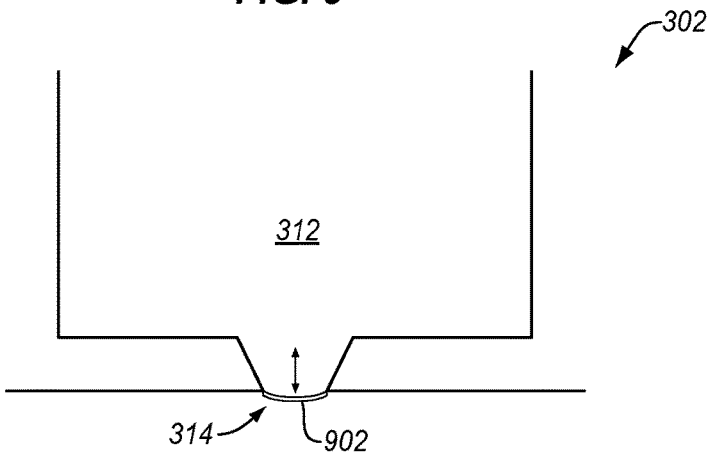
FIG. 9 is a schematic diagram of a jetting channel in an illustrative embodiment.

FIG. 9 is a schematic diagram of jetting channel 302 in an illustrative embodiment. A fluid meniscus 902 is the fluid-air interface at nozzle 314. When non-jetting pulse 830 is applied to piezoelectric actuator 310 of jetting channel 302, the piezoelectric actuator 310 will slightly deform but will not deform enough to create pressure waves within pressure chamber 312 that eject a droplet from nozzle 314. The slight deformation is, however, is enough to cause fluid meniscus 902 at the nozzle 314 to move. A technical benefit of causing movement of fluid meniscus 902 is that settling or hardening of the print fluid at nozzle 314 and within pressure chamber 312 is slowed or prevented, which improves the reliability of a printhead. This can be particularly advantageous when jetting print fluids, such as solvent-based inks or high-pigment inks, and one or more jetting channels 302 are inactive for an extended period of time during operation.

Another technical benefit is that drive waveform 404 does not have to be altered to create a non-jetting pulse, and may consist solely of jetting pulses 500. A conventional drive waveform may be altered to include both non-jetting pulses and jetting pulses. But there is a time penalty for having non-jetting pulses and jetting pulses on the same drive waveform. Because inactive gating signal 610 acts to convert a jetting pulse 500 to a non-jetting pulse 830, drive waveform 404 may consist of a train of jetting pulses 500, which allows for higher frequency printing.

Figure 10:
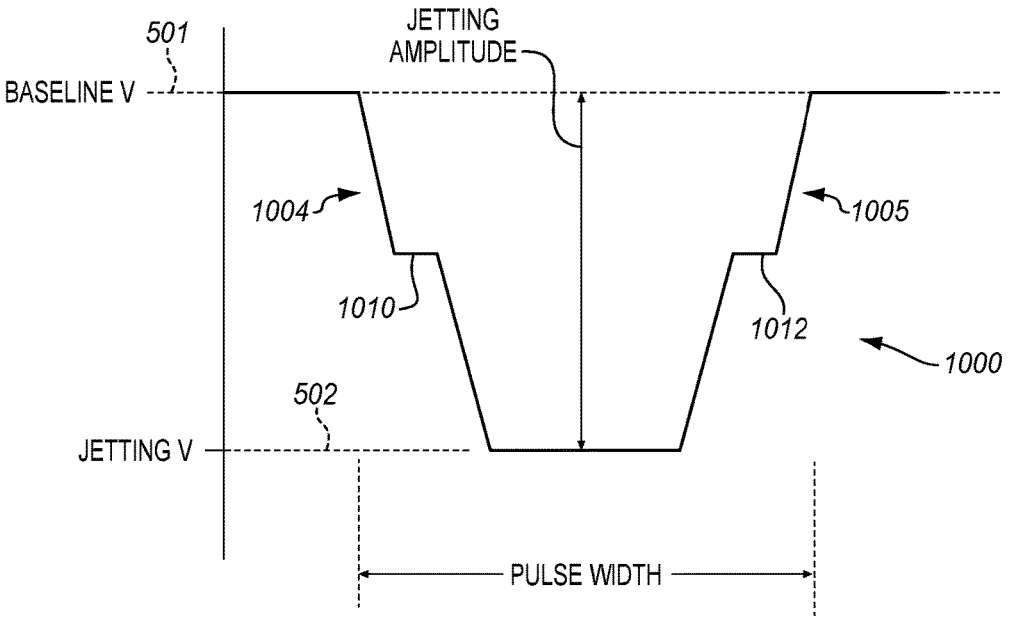
FIG. 10 illustrates another jetting pulse of a drive waveform for a printhead in an illustrative embodiment.

FIG. 10 illustrates another jetting pulse 1000 of a drive waveform for a printhead in an illustrative embodiment. The drive waveform in FIG. 10 is shown as an active-low signal, but may be an active-high signal in other embodiments. Jetting pulse 1000 again has a trapezoidal shape, but is a stepped-slope pulse. In other words, as jetting pulse 1000 transitions from a baseline (high) voltage 501 to a jetting (low) voltage 502 along leading edge 1004, the slope of leading edge 1004 includes a step 1010. As jetting pulse 1000 transitions from jetting (low) voltage 502 to baseline (high) voltage 501 along a trailing edge 1005, the slope of trailing edge 1005 includes a step 1012. Steps 1010 and 1012 may be selected at a non-jetting voltage of a piezoelectric actuator 310.

Figure 11:
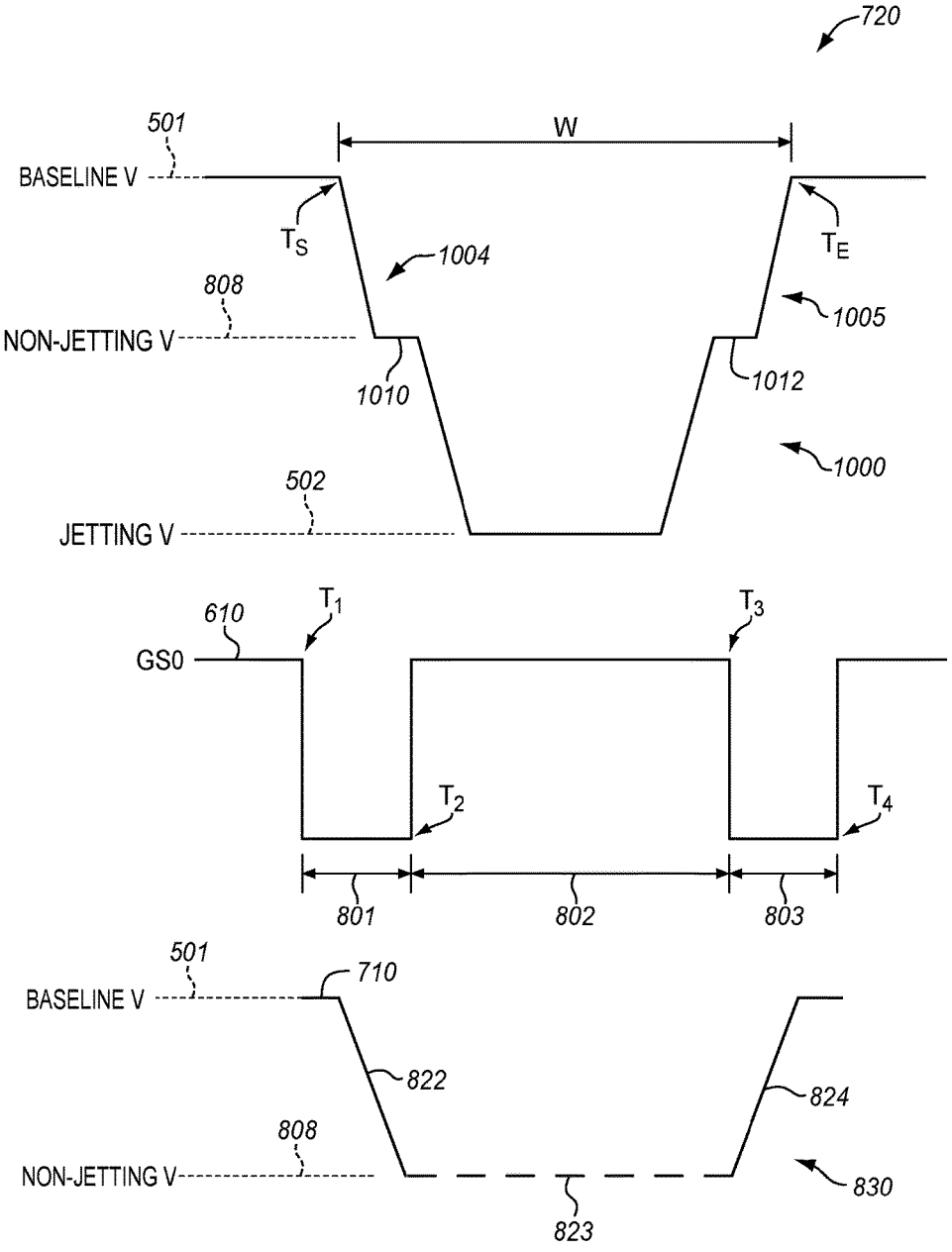
FIG. 11 illustrates a time interval using a jetting pulse of FIG. 10 in an illustrative embodiment.

FIG. 11 illustrates time interval 720 in FIG. 7 using jetting pulse 1000 in an illustrative embodiment. Jetting pulse 1000 again has a pulse width (W) starting at time $T_S$ and ending at time $T_E$. The pattern or timing of inactive gating signal 610 is that it is on for a first time window 801 for a portion of the leading edge 1004 of jetting pulse 1000 between the baseline voltage 501 and step 1010 of leading edge 1004, is off for a second time window 802 between step 1010 of leading edge 1004 and step 1012 of trailing edge 1005, and is on for a third time window 803 for a portion of the trailing edge 1005 of jetting pulse 1000 between step 1012 and the baseline voltage 501.

The pattern or timing of inactive gating signal 610 acts to clip the amplitude of jetting pulse 1000 to generate a non-jetting pulse 830. At or before time $T_S$, inactive gating signal 610 transitions from off to on at time $T_1$. With inactive gating signal 610 on, a switching element 606 will allow a portion of the jetting pulse 1000 (i.e., a portion of the leading edge 1004) to pass to a piezoelectric actuator 310 on output signal 710 during time window 801. The portion of the jetting pulse 1000 that is allowed to pass during time window 801 generates leading edge 822 of non-jetting pulse 830. Inactive gating signal 610 transitions from on to off at time $T_2$ during step 1010 on leading edge 1004 of jetting pulse 1000. With inactive gating signal 610 off, switching element 606 will block a portion of the jetting pulse 1000 from piezoelectric actuator 310 on output signal 710 during time window 802. Because jetting pulse 1000 is blocked during time window 802, no signal will be output on output signal 710 from switching element 606. Thus, this portion of non-jetting pulse 830 is illustrated as a dotted line, and represents a peak amplitude 823. Inactive gating signal 610 transitions from off to on at time $T_3$ during step 1012 on trailing edge 1005 of jetting pulse 1000. With inactive gating signal 610 on, switching element 606 will allow a portion of the jetting pulse 1000 (i.e., a portion of the trailing edge 1005) to pass to a piezoelectric actuator 310 on output signal 710 during time window 803. The portion of the jetting pulse 1000 that is allowed to pass during time window 803 generates trailing edge 824 of non-jetting pulse 830. Inactive gating signal 610 then transitions from on to off at time $T_4$ after or when the trailing edge 1005 of jetting pulse 1000 reaches the baseline voltage 501.

Figure 12:
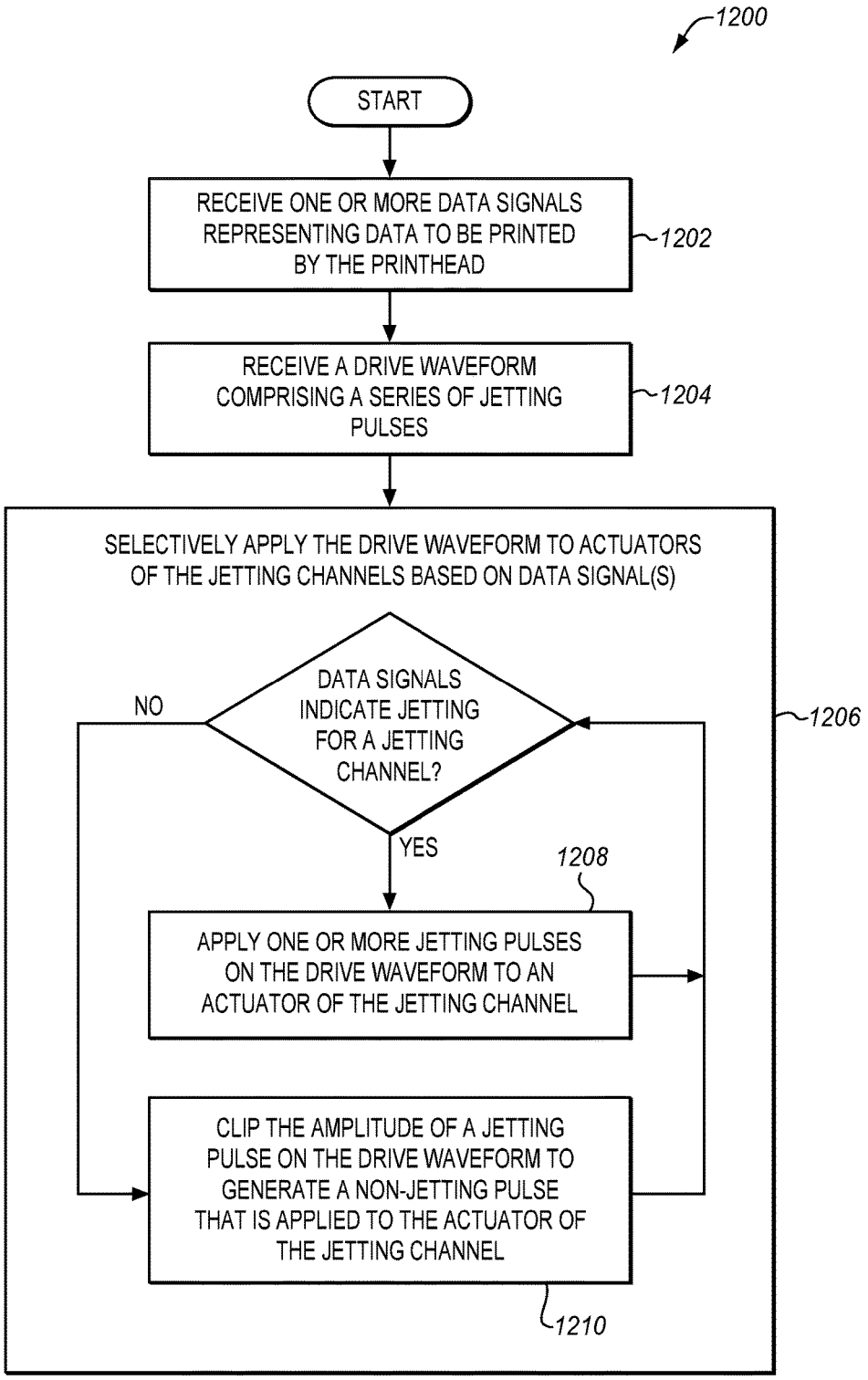
FIG. 12 is a flow chart illustrating a method of driving a printhead in an illustrative embodiment.

FIG. 12 is a flow chart illustrating a method 1200 of driving a printhead in an illustrative embodiment. The steps of method 1200 will be described with reference to drive circuit 400 in FIG. 4, but those skilled in the art will appreciate that method 1200 may be performed in other systems or circuits. Also, the steps of the flow charts described herein are not all inclusive and may include other steps not shown, and the steps may be performed in an alternative order.

Figure 13:
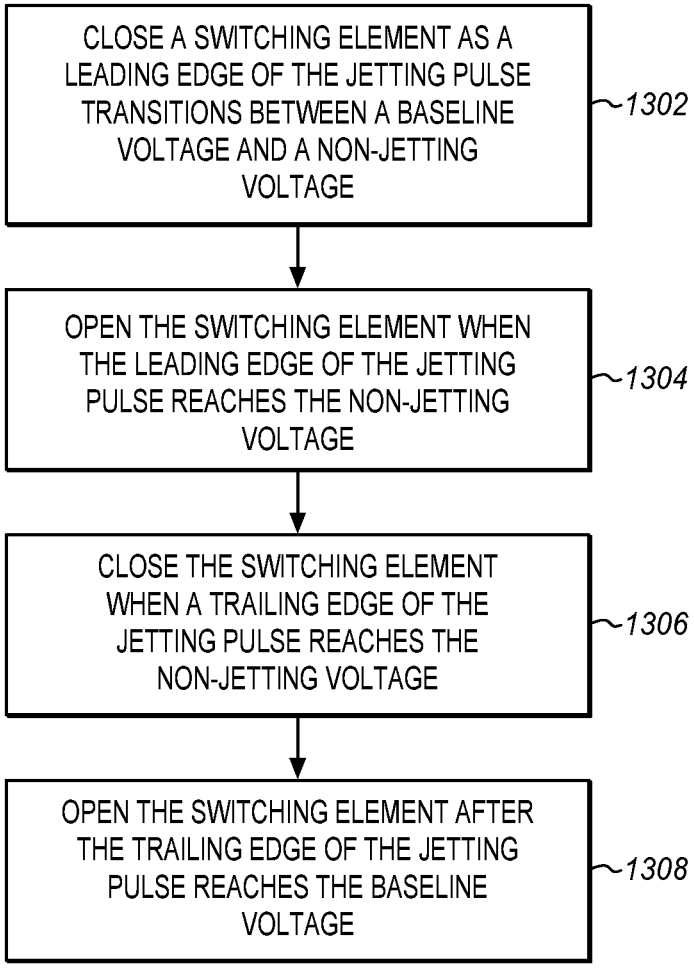
FIG. 13 illustrates steps for controlling a switching element to clip an amplitude of a jetting pulse in an illustrative embodiment.

One assumption for method 1200 is that the printhead includes one or more rows of jetting channels, such as jetting channels 302 in printhead 104. Head driver 410 receives one or more data signals representing data to be printed by the printhead (step 1202). Head driver 410 also receives a drive waveform comprising a series of jetting pulses (step 1204). Each of the jetting pulses has an amplitude configured to eject a droplet from a jetting channel. Head driver 410, as illustrated in FIG. 6, includes a plurality of switching elements 606, and a switching element 606 is implemented for each jetting channel to control whether a drive waveform is allowed to pass to an actuator (e.g., a piezoelectric actuator) of the jetting channel. The switching elements 606 are controlled to selectively apply the drive waveform to actuators of the jetting channels based on data signal(s) (step 1206). For step 1206, when the data signal(s) indicate jetting by a jetting channel during a jetting period, a switching element is controlled to apply one or more jetting pulses on the drive waveform to an actuator of the jetting channel (step 1208). When the data signal(s) do not indicate jetting or indicate non-jetting by the jetting channel during the jetting period, the switching element is controlled to clip the amplitude of a jetting pulse on the drive waveform to generate a non-jetting pulse that is applied to the actuator of the jetting channel (step 1210). FIG. 13 illustrates steps for controlling the switching element to clip the amplitude of the jetting pulse in an illustrative embodiment. Switching element 606 is closed as a leading edge of the jetting pulse transitions between a baseline voltage and a non-jetting voltage (step 1302). Switching element 606 is opened when the leading edge of the jetting pulse reaches the non-jetting voltage (step 1304). Switching element 606 is closed when a trailing edge of the jetting pulse reaches the non-jetting voltage (step 1306). Switching element 606 may then be opened after the trailing edge of the jetting pulse reaches the baseline voltage (step 1308).

Figure 14:
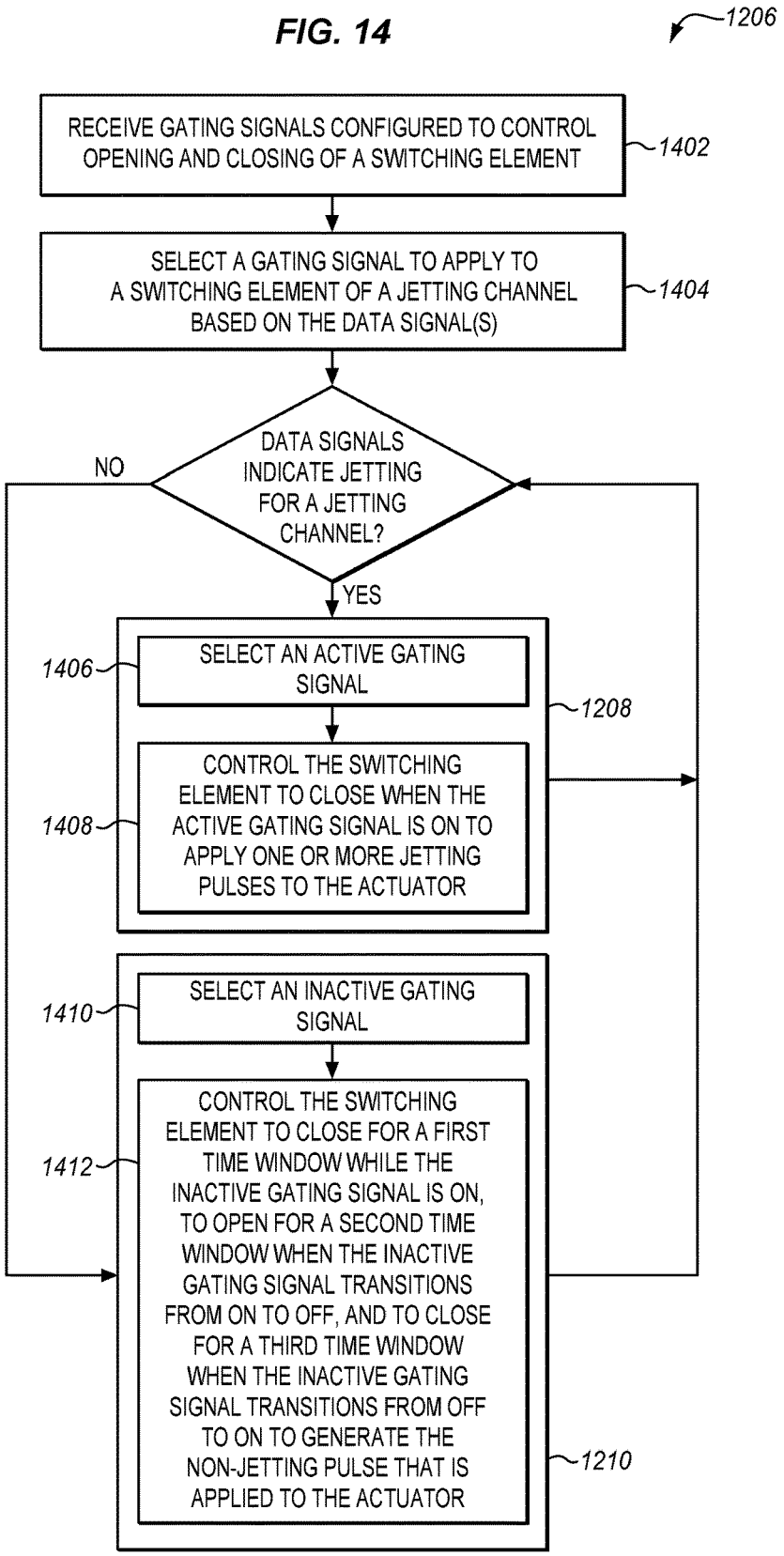
FIG. 14 illustrates additional steps for the method shown in FIG. 12 in an illustrative embodiment.

FIG. 14 illustrates additional steps for method 1200 in an illustrative embodiment. Additional steps 1402 and 1404 may be performed are part of step 1206 shown in FIG. 12. Head driver 410 receives a plurality of gating signals configured to control opening and closing of a switching element 606 (step 1402). The gating signals include an inactive gating signal and one or more active gating signals, and these gating signals are used to control switching elements 606 of the jetting channels. Head driver 410 (i.e., through a selector 608) also selects a gating signal to apply to a switching element 606 of a jetting channel based on the data signal(s) (step 1404). One or more of the active gating signals is on for a duration equal to or larger than a pulse width of the jetting pulse. Thus, these active gating signals will control a switching element 606 to allow one or more jetting pulses to pass to an actuator. The inactive gating signal transitions between on and off during a pulse width of the jetting pulse to clip the amplitude of the jetting pulse to generate the non-jetting pulse. This type of inactive gating signal, such as inactive gating signal 610 shown in FIGS. 7-8, acts to convert a jetting pulse to a non-jetting pulse.

When using gating signals such as this, step 1208 of method 1200 may include selecting an active gating signal for a jetting channel in response to the data signal(s) indicating jetting by the jetting channel (step 1406), and controlling the switching element 606 to close when the active gating signal is on to apply one or more jetting pulses to the actuator (step 1408). Step 1210 of method 1200 may include selecting an inactive gating signal for a jetting channel in response to the data signal(s) indicating non-jetting by the jetting channel (step 1410), and controlling the switching element 606 to close for a first time window while the inactive gating signal is on, to open for a second time window when the inactive gating signal transitions from on to off, and to close for a third time window when the inactive gating signal transitions from off to on to generate the non-jetting pulse that is applied to the actuator (step 1412).

Additional method steps may be employed in addition to those described above, and such method steps may be gleaned from the description provided above.

Any of the various elements or modules shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope of the invention is not limited to those specific embodiments. The scope of the invention is defined by the following claims and any equivalents thereof.

What is claimed is:

1. A printhead comprising:

at least one row of jetting channels configured to jet droplets of a print fluid, wherein each of the jetting channels comprises an actuator, a pressure chamber, and a nozzle; and a head driver configured to receive at least one data signal, and to receive a drive waveform comprising a series of jetting pulses, wherein each of the jetting pulses has an amplitude configured to eject a droplet from a jetting channel;

the head driver, responsive to the at least one data signal indicating jetting by a jetting channel during a jetting period, is configured to apply at least one of the jetting pulses on the drive waveform to the actuator of the jetting channel;

the head driver, responsive to the at least one data signal indicating non-jetting by the jetting channel during the jetting period, is configured to clip the amplitude of a jetting pulse on the drive waveform to generate a non-jetting pulse that is applied to the actuator of the jetting channel;

wherein the non-jetting pulse is configured to activate the actuator of the jetting channel to create movement of a fluid meniscus at the nozzle of the jetting channel without ejecting a droplet.

2. The printhead of claim 1 wherein:

the head driver includes a plurality of switching elements configured to selectively apply the drive waveform to actuators of the jetting channels based on the at least one data signal; and the head driver is configured to clip the amplitude of the jetting pulse to generate the non-jetting pulse by being configured to:

close a switching element as a leading edge of the jetting pulse transitions between a baseline voltage and a non-jetting voltage:

open the switching element when the leading edge of the jetting pulse reaches the non-jetting voltage; and close the switching element when a trailing edge of the jetting pulse reaches the non-jetting voltage.

3. The printhead of claim 1 wherein:

the head driver includes a plurality of switching elements configured to selectively apply the drive waveform to actuators of the jetting channels based on the at least one data signal;

the head driver is configured to receive a plurality of gating signals configured to control opening and closing of the switching elements;

at least a first one of the gating signals is on for a duration equal to or larger than a pulse width of the jetting pulse; and a second one of the gating signals transitions between on and off during the pulse width of the jetting pulse to clip the amplitude of the jetting pulse.

4. The printhead of claim 3 wherein:

the second one of the gating signals is on at initiation of a leading edge of the jetting pulse, transitions from on to off when the leading edge of the jetting pulse reaches a non-jetting voltage, and transitions from off to on when a trailing edge of the jetting pulse reaches the non-jetting voltage.

5. The printhead of claim 1 wherein:

the actuator comprises a piezoelectric actuator.

6. The printhead of claim 1 wherein:

the jetting pulses include a first stepped-slope on a leading edge, and a second stepped-slope on a trailing edge.

7. A drive circuit for a printhead comprising at least one row of jetting channels configured to jet droplets of a print fluid using actuators, the drive circuit comprising:

a head driver comprising:

an electrical interface configured to receive at least one data signal representing data to be printed by the printhead;

an electrical bus configured to receive a drive waveform comprising a series of jetting pulses, wherein each of the jetting pulses has an amplitude configured to eject a droplet from a jetting channel; and a plurality of switching elements, wherein a switching element of the plurality of switching elements is connected between the electrical bus and an actuator of a jetting channel;

wherein the switching element is configured to close to enable a conductive path between the electrical bus and the actuator, and to open to disable the conductive path;

wherein responsive to the at least one data signal indicating jetting by the jetting channel during a jetting period, the switching element is configured to apply at least one of the jetting pulses on the drive waveform to the actuator;

wherein responsive to the at least one data signal indicating non-jetting by the jetting channel during the jetting period, the switching element is configured to clip the amplitude of a jetting pulse on the drive waveform to generate a non-jetting pulse that is applied to the actuator;

wherein the non-jetting pulse is configured to activate the actuator of the jetting channel to create movement of a fluid meniscus at a nozzle of the jetting channel without ejecting a droplet.

8. The drive circuit of claim 7 wherein:

the switching element is configured to clip the amplitude of the jetting pulse to generate the non-jetting pulse by being configured to:

close as a leading edge of the jetting pulse transitions between a baseline voltage and a non-jetting voltage;

open when the leading edge of the jetting pulse reaches the non-jetting voltage; and close when a trailing edge of the jetting pulse reaches the non-jetting voltage.

9. The drive circuit of claim 7 wherein the head driver further comprises:

a selector coupled to the switching element;

wherein the electrical interface is configured to receive a plurality of gating signals configured to control opening and closing of the switching element;

wherein the selector is configured to select among the gating signals to apply to the switching element during the jetting period based on the at least one data signal;

wherein at least a first one of the gating signals is on for a duration equal to or larger than a pulse width of the jetting pulse; and wherein a second one of the gating signals transitions between on and off during the pulse width of the jetting pulse to clip the amplitude of the jetting pulse.

10. The drive circuit of claim 9 wherein:

the second one of the gating signals is on at initiation of a leading edge of the jetting pulse, transitions from on to off when the leading edge of the jetting pulse reaches a non-jetting voltage, and transitions from off to on when a trailing edge of the jetting pulse reaches the non-jetting voltage.

11. The drive circuit of claim 10 wherein:

the selector is configured to select the first one of the gating signals in response to the at least one data signal indicating jetting by the jetting channel; and the switching element is configured to close when the first one of the gating signals is on to apply the jetting pulse to the actuator.

12. The drive circuit of claim 11 wherein:

the selector is configured to select the second one of the gating signals in response to the at least one data signal indicating non-jetting by the jetting channel; and the switching element is configured to close for a first time window while the second one of the gating signals is on, to open for a second time window when the second one of the gating signals transitions from on to off, and to close for a third time window when the second one of the gating signals transitions from off to on to generate the non-jetting pulse that is applied to the actuator.

13. The drive circuit of claim 7 wherein:

the actuator comprises a piezoelectric actuator.

14. The drive circuit of claim 7 wherein:

the jetting pulses include a first stepped-slope on a leading edge, and a second stepped-slope on a trailing edge.

15. A method for driving a printhead comprising at least one row of jetting channels configured to jet droplets of a print fluid, the method comprising:

receiving, at a head driver, at least one data signal;

receiving, at the head driver, a drive waveform comprising a series of jetting pulses, wherein each of the jetting pulses has an amplitude configured to eject a droplet from a jetting channel;

selectively applying, at the head driver, the drive waveform to actuators of the jetting channels based on the at least one data signal;

wherein when the at least one data signal indicates jetting by a jetting channel during a jetting period, selectively applying the drive waveform comprises applying at least one of the jetting pulses on the drive waveform to an actuator of the jetting channel;

wherein when the at least one data signal indicates non-jetting by the jetting channel during the jetting period, selectively applying the drive waveform comprises clipping the amplitude of a jetting pulse on the drive waveform to generate a non-jetting pulse that is applied to the actuator of the jetting channel;

wherein an amplitude of the non-jetting pulse is configured to activate the actuator of the jetting channel to create movement of a fluid meniscus at a nozzle of the jetting channel without ejecting a droplet.

16. The method of claim 15 wherein clipping the amplitude of the jetting pulse comprises:

closing a switching element at the head driver as a leading edge of the jetting pulse transitions between a baseline voltage and a non-jetting voltage;

opening the switching element when the leading edge of the jetting pulse reaches the non-jetting voltage; and closing the switching element when a trailing edge of the jetting pulse reaches the non-jetting voltage.

17. The method of claim 15 further comprising:

receiving, at the head driver, a plurality of gating signals configured to control opening and closing of a switching element of the head driver; and selecting among the gating signals to apply to the switching element during the jetting period based on the at least one data signal;

wherein at least a first one of the gating signals is on for a duration equal to or larger than a pulse width of the jetting pulse; and wherein a second one of the gating signals transitions between on and off during the pulse width of the jetting pulse to clip the amplitude of the jetting pulse.

18. The method of claim 17 wherein:

the second one of the gating signals is on at initiation of a leading edge of the jetting pulse, transitions from on to off when the leading edge of the jetting pulse reaches a non-jetting voltage, and transitions from off to on when a trailing edge of the jetting pulse reaches the non-jetting voltage.

19. The method of claim 18 wherein selectively applying the drive waveform comprises:

selecting the first one of the gating signals in response to the at least one data signal indicating jetting by the jetting channel; and controlling the switching element to close when the first one of the gating signals is on to apply the jetting pulse to the actuator.

20. The method of claim 19 wherein selectively applying the drive waveform comprises:

selecting the second one of the gating signals in response to the at least one data signal indicating non-jetting by the jetting channel; and controlling the switching element to close for a first time window when the second one of the gating signals is on, to open for a second time window when the second one of the gating signals transitions from on to off, and to close for a third time window when the second one of the gating signals transitions from off to on to generate the non-jetting pulse that is applied to the actuator.

* * * * *